US005167771A

United States Patent [19]

Sayers et al.

[11] Patent Number: 5,167,771

[45] Date of Patent: Dec. 1, 1992

[54] EXTENDED NIP DEWATERING PRESS BELT WITH REINFORCED RIBS

[75] Inventors: Ian C. Sayers, Ribchester; John Jeffery, Blackburn, both of United Kingdom

[73] Assignee: Scapa Group plc, Blackburn, England

[21] Appl. No.: 735,678

[22] Filed: Jul. 29, 1991

Related U.S. Application Data

[63] Continuation of Ser. No. 390,249, Aug. 7, 1989, abandoned.

[30] Foreign Application Priority Data

Aug. 10, 1988 [GB] United Kingdom ..... 8818992

[51] Int. Cl.[5] ..... D21F 3/02

[52] U.S. Cl. ..... 162/358.4; 162/901; 428/180; 428/295; 198/847

[58] Field of Search ..... 162/358, 361, DIG. 1; 198/846, 847; 428/167, 180, 295

[56] References Cited

U.S. PATENT DOCUMENTS

| | | | |
|---|---|---|---|
| 3,880,274 | 4/1975 | Bechtloff | 198/846 |
| 4,482,430 | 11/1984 | Majaniemi | 162/358 |
| 4,533,040 | 8/1985 | Howerton | 198/847 |
| 4,533,420 | 8/1985 | Wetzel | 198/847 |
| 4,559,258 | 12/1985 | Kiuchi | 162/358 |
| 4,642,082 | 2/1987 | Mashimo et al. | 198/846 |
| 4,740,409 | 4/1988 | Lefkowitz | 428/131 |
| 4,944,820 | 7/1990 | McCarten | 156/154 |

FOREIGN PATENT DOCUMENTS

| | | | |
|---|---|---|---|
| 87/02080 | 4/1987 | PCT Int'l Appl. | 162/358 |
| 2202873 | 3/1988 | United Kingdom . | |

*Primary Examiner*—Karen M. Hastings
*Attorney, Agent, or Firm*—Keck, Mahin & Cate

[57] ABSTRACT

An ENP belt for use in the press-section of a papermaking machine is disclosed which comprises a sheet-like body part (11) having integrally formed machine-direction ribs (12) extending outwardly from the surface therefrom, there being reinforcing yarns (16) in register with respective ones of some at least of the said ribs (12) and at least partially located therein. Cross machine direction ribs (15) extending between adjacent machine direction ribs may be provided, if desired.

25 Claims, 2 Drawing Sheets

EXTENDED NIP DEWATERING PRESS BELT WITH REINFORCED RIBS

This application is a continuation of application Ser. No. 07/390,249, filed Aug. 7, 1989, now abandoned.

The invention concerns improvements in or relating to extended nip dewatering presses and has more particular reference to a belt for use in the context of such presses.

In the press section of a papermaking machine the paper web, interposed between two moisture-absorbing felts, moves in pressure contact with a press roll, being urged into such contact by a pressure shoe acting through a belt in contact with the outermost, in relation to the press roll, of the moisture absorbing felts.

The pressures applied by the shoe and the need to maximise removal of water from the paper web impose limitations on belt design, and the primary object of the present invention is to provide a belt for an extended nip press which will be capable of withstanding the pressures to which it will be subjected in use without substantial prejudice to the water conveying capabilities thereof.

According to the present invention there is proposed an ENP belt for the press-section of a papermaking machine or the like, the belt comprising an impermeable sheet-like base structure, a multiplicity of integral, closely-spaced upstanding ribs at one face of the base structure and extending in the running direction thereof, the other face of the belt being smooth, and reinforcing yarns extending longitudinally of some at least of the said ribs and positioned in register therewith at least partially to engage the same.

According to a preferred feature, the reinforcing yarns comprise monofilament yarns.

According to a further preferred feature, the belt further includes a multiplicity of supplementary ribs arranged in spaced apart disposition and extending transversely of the base structure, the said supplementary ribs cooperating with the said upstanding ribs to form a multiplicity of cavities at the said one face of the base structure.

Preferably the supplementary ribs are of a lesser height than the upstanding ribs.

BRIEF DESCRIPTION OF THE DRAWINGS

The invention will now be described further, by way of example, with reference to the accompanying diagrammatic drawings illustrating one embodiment thereof and in which.

Figure 1:
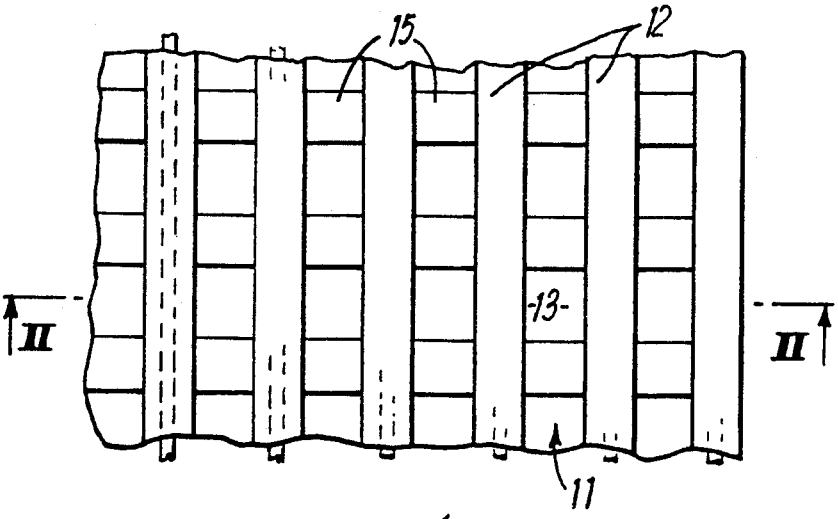
FIG. 1 is a plan view of a part of a first form of belt constructed in accordance with the invention.
Figure 2:
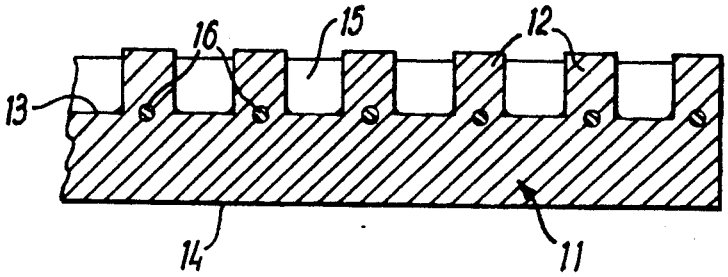
FIG. 2 is a section on line II—II of FIG. 1.

Referring now to the drawings, and particularly to FIGS. 1 and 2 thereof, an ENP belt for the press section of a papermaking machine comprises an impermeable, sheet-like body part 11 having a multiplicity of upstanding, machine-direction ribs 12 at one face 13 thereof, the other face 14 being smooth, and a multiplicity of spaced, parallel supplementary ribs 15 at the said one face 13 and at right angles to the upstanding ribs 12. Upstanding ribs 12 are of a different height than supplementary ribs 15, as shown in FIG. 2. Preferably, the supplementary ribs are of a lesser height than the upstanding ribs.

A reinforcing yarn 16 is provided in each respective rib 12, the yarns 16 being at least partially embedded within the ribs 12; if preferred the yarns may exist wholly with the respective ribs and in spaced disposition therein with respect to the body part 11.

The cavities formed by and between the ribs 12, 15 are of generally rectangular form, when considered in plan view, the major dimension thereof extending in the running direction of the belt. In size, the cavities are typically 2 mm×2.5 mms.

The overall thickness of the belt is typically 5 mm, the body part having a thickness of approximately 3 mm.

The reinforcing yarns 16 will ordinarily comprise a monofilament of polyester, polyamide or other synthetic material of application to the context of papermachine clothing, and will typically be of 0.5 mm diameter.

The body part 11 and the ribs 12, 15 are formed from an elastomeric resin of high abrasion resistance, for example thermoplastic rubber as sold by Monsanto under the Trade Mark SANTOPRENE or polyurethane.

If desired, the supplementary ribs 15, which ribs are typically 1.75 mm wide, may be reinforced with chopped monofilament yarns, although other materials such as, for example, glass yarns may be used.

The belt is conveniently made in accordance with the method discussed in British Patent Application No. 8807416.6, published on Oct. 5, 1988, as United Kingdom Patent Application GB 2202873A, based upon U.S. Pat. No. 4,740,409, issued Apr. 26, 1988, incorporated herein by reference, an array of spaced side-by-side yarns, being the reinforcing yarns 16 hereof, being advanced in the longitudinal direction thereof into contact with a polymeric matrix material. The yarns become embedded in the matrix material on passage through a roller nip, the rollers defining the roller nip having a pinned section thereon adapted and arranged to form recesses in the matrix material, to define longitudinal and transverse ribs respectively corresponding to the upstanding ribs 12 and the supplementary ribs 15 of the belt of the invention, between adjacent yarns. By arranging that the pins of the pinned section do not make contact with the opposing roller surface at the roller nip, recesses rather than apertures are formed in the matrix on movement thereof through the nip.

However, it is also contemplated that the matrix may be formed with apertures therein and that one face of the resultant structure will be rendered impermeable to moisture by the application of a thin sheet of a similar or compatible elastomeric material.

In accordance with the teaching of the copending application aforesaid, the leading end of the tape formed on passage through the roller nip passes round a tail roll and is returned to the roller nip in side-by-side disposition relative to fresh matrix material and yarns moving to that nip for combination thereat, the procedure continuing thus to provide a belt of requisite length and width.

As will be appreciated, when produced in accordance with the method of the copending application aforesaid, the reinforcing yarns will exist in helical form in the endless belt and will extend substantially in the running direction thereof.

The presence of the reinforcing yarns in the longitudinally extending ribs will serve the twofold purpose of providing dimensional stability in the direction of the ribs and of reducing the incidence of crushing of the ribs. Accordingly, the belt will be well fitted to withstand the pressures ordinarily met with in the context of an extended-nip press without deleterious effect on the water conveying capabilities of the cavities.

Figure 3:
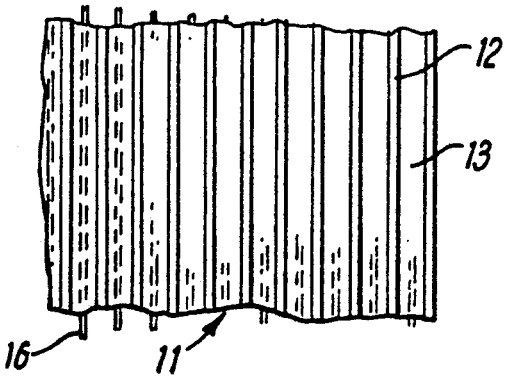
FIG. 3 is a view corresponding to FIG. 1 and shows a second embodiment of the invention.

In the alternative arrangement shown in FIG. 3, no transverse ribs are provided, the method of manufacture herein briefly described being modified by utilising ribs on the nip rollers rather than the pinned section previously mentioned. Typically the ribs will be 1.75 mm wide and adjacent ribs will be separated by a distance of 0.75 mm.

Figure 4:
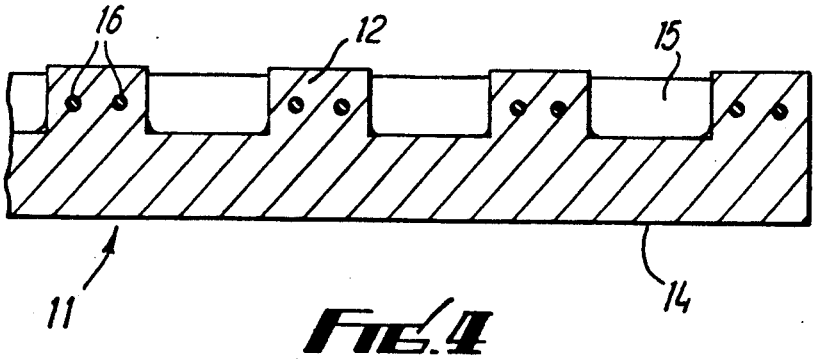
FIG. 4 is a view corresponding to FIG. 2, and shows a third embodiment of the invention.

It is to be appreciated that whilst a reinforcing yarn is preferably provided in each longitudinal rib, it may be found sufficient, in some circumstances, for such yarns to be present in some only of the ribs. In a still further arrangement, multiple monofilament yarns are provided in some or all of the ribs, the relative disposition of the yarns being determined by specific requirements. In the case of two yarns within a rib, as shown in FIG. 4, such yarns may be provided adjacent the respective upper edges thereof.

Single and multiple yarn configurations may be utilised in combination, if desired, in a particular structure, and some ribs may be devoid of reinforcement.

Whilst the invention has been described in relation to monofilament yarns of circular cross-section, alternative yarn forms may be preferred in some instances. For example, the yarns provided within the belt may comprise resin-treated multifilament yarns or overwrapped monofilament yarn.

Figure 5:
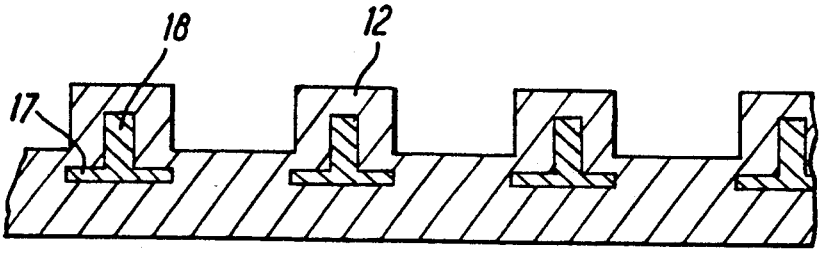
FIG. 5 is another view corresponding to FIG. 2 and illustrates a still further embodiment.

As a further alternative to the monofilament yarns as shown in FIGS. 1 to 4, such yarns may be of profiled form, for example as shown in FIG. 5. In the case of the FIG. 5 embodiment, the body part 17 of the yarn profile is located within the base of the belt and the upstanding part 18 thereof extends into the rib 12, the width w of the body part 17 preferably exceeding twice the height h of the upstanding part 18.

The invention is not limited to endless belts made in accordance with the method of the copending application hereinmentioned, or indeed to endless belts, although the primary application of the invention is in the context of endless belts and particularly those made in accordance with the method of the said application.

We claim:

1. In a press-section of a papermaking machine, an extended nip press belt having a running direction, the belt comprising an impermeable sheet-like base structure having inner and outer faces, a multiplicity of integrally-formed, closely-spaced upstanding ribs at said outer face and extending in the running direction thereof, the inner face of the belt being smooth, and reinforcing yarns extending longitudinally of at least some of said upstanding ribs and positioned in register therewith at least partially to engage the same, a multiplicity of supplementary ribs arranged in spaced apart disposition and extending transversely of the base structure at said outer face, said supplementary ribs cooperating with said upstanding ribs to form a multiplicity of cavities at said outer face, said supplementary ribs being of a different height than said upstanding ribs.

2. A belt as claimed in claim 1, wherein the reinforcing yarns comprise monofilament yarns.

3. A belt as claimed in claim 2, wherein the monofilament yarn is overwrapped.

4. A belt as claimed in claim 2, wherein the reinforcing yarns are of non-circular transverse cross-section.

5. A belt as claimed in claim 1, wherein the supplementary ribs include a reinforcement comprising chopped multifilament yarns.

6. A belt as claimed in claim 5 wherein the supplementary ribs are of a lesser height than the upstanding ribs.

7. A belt as claimed in claim 1, including multiple reinforcing yarns in some at least of the upstanding ribs.

8. A belt as claimed in claim 7, wherein the reinforcing yarns are located wholly within the respective ribs.

9. A belt as claimed in claim 1, wherein said cavities are rectangular shaped.

10. A belt as claims in claim 9, wherein a major dimension of said cavities extends in the running direction.

11. In a press section of a papermaking machine, an extended nip press belt having a running direction, the belt comprising an impermeable, sheet-like body part having outwardly facing first and second faces thereto, a multiplicity of integrally formed upstanding ribs at one face of the body part and extending in the running direction of the belt, a multiplicity of spaced, parallel supplementary ribs extending from said one face and arranged transversely of said upstanding ribs to extend therebetween, and reinforcing yarns in at least some of said upstanding ribs and extending longitudinally thereof, the reinforcing yarns being of non-circular monofilament form, said supplementary ribs being of a different height than said upstanding ribs.

12. A belt as claimed in claim 11 wherein the supplementary ribs are of a lesser height than the upstanding ribs.

13. A belt as claimed in claim 11, wherein the reinforcing yarns are of T-shaped transverse cross-section arranged in inverted disposition with respect to the upstanding ribs.

14. A belt as claimed in claim 11, wherein said cavities are rectangular shaped.

15. A belt as claimed in claim 14, wherein a major dimension of said cavities extends in the running direction.

16. In a press-section of a papermaking machine, an extended nip press belt having a running direction, the belt comprising an impermeable sheet-like base structure having inner and outer faces, a multiplicity of closely-spaced upstanding ribs formed integrally with said base structure at said outer face and extending in the running direction thereof, the inner face of the belt being smooth, and continuous monofilaments reinforcing yarns extending only longitudinally of and in register with at least some of said upstanding ribs and positioned at least partially embedded within said upstanding ribs so that said reinforcing yarns are completely surrounded and in intimate contact with the integral base structure and upstanding ribs.

17. A belt as claimed in claim 16, further including a multiplicity of supplementary ribs arranged in spaced apart disposition and extending transversely of the base structure at said outer face, said supplementary ribs cooperating with said upstanding ribs to form a multiplicity of cavities at said outer face.

18. A belt as claimed in claim 16, wherein said reinforcing yarns are located wholly within said upstanding ribs and in spaced disposition with respect to said base structure.

19. In a press-section of a papermaking machine, an extended nip press belt having a running direction, the belt comprising an impermeable sheet-like base structure having inner and outer faces, a multiplicity of closely-spaced upstanding ribs formed integrally with said base structure at said outer face and extending in the running direction thereof, the inner face of the belt being smooth, and continuous monofilament reinforcing yarns extending only longitudinally of and in register with at least some of said upstanding ribs and positioned at least partially embedded in said upstanding ribs, a multiplicity of supplementary ribs arranged in spaced apart disposition and extending transversely of the base structure at said outer face, said supplementary ribs cooperating with said upstanding ribs to form a multiplicity of cavities at said outer face.

20. A belt as claimed in claim 19, wherein said supplementary ribs are of a different height than said upstanding ribs.

21. A belt as claimed in claim 20, wherein said supplementary ribs are of a lesser height than said upstanding ribs.

22. A belt as claimed in claim 19, wherein said reinforcing yarns are located wholly within said upstanding ribs and in spaced disposition with respect to said base structure.

23. A belt as claimed in claim 19, wherein said cavities are rectangular shaped.

24. A belt as claimed in claim 23, wherein a major dimension of said cavities extends in the running direction.

25. In a press-section of a papermaking machine, an extended nip press belt having a running direction, the belt comprising an impermeable sheet-like base structure having inner and outer faces, a multiplicity of closely-spaced upstanding ribs formed integrally with said base structure at said outer face and extending in the running direction thereof, the inner face of the belt being smooth, and continuous monofilament reinforcing yarns extending only longitudinally of and in register with at least some of said upstanding ribs and positioned at least partially embedded within said upstanding ribs so that said reinforcing yarns are completely surrounded with and in a region of the integral base structure and upstanding ribs.

* * * * *